US007362053B2

(12) United States Patent
Wei et al.

(10) Patent No.: US 7,362,053 B2
(45) Date of Patent: Apr. 22, 2008

(54) CERAMIC DISCHARGE VESSEL HAVING ALUMINUM OXYNITRIDE SEAL REGION

(75) Inventors: George C. Wei, Weston, MA (US); Harry S. Mackel, Pepperell, MA (US)

(73) Assignee: Osram Sylvania Inc., Danvers, MA (US)

( * ) Notice: Subject to any disclaimer, the term of this patent is extended or adjusted under 35 U.S.C. 154(b) by 262 days.

(21) Appl. No.: 11/047,069

(22) Filed: Jan. 31, 2005

(65) Prior Publication Data

US 2006/0170362 A1 Aug. 3, 2006

(51) Int. Cl.
*H01J 17/18* (2006.01)
*H01J 61/36* (2006.01)

(52) U.S. Cl. ..... 313/636; 313/623

(58) Field of Classification Search ..... 313/636, 313/623

See application file for complete search history.

(56) References Cited

U.S. PATENT DOCUMENTS

| | | | | |
|---|---|---|---|---|
| 3,026,210 A | | 3/1962 | Coble | 106/39 |
| 4,076,991 A | * | 2/1978 | Datta | 313/624 |
| 4,481,300 A | | 11/1984 | Hartnett et al. | 501/98 |
| 4,520,116 A | | 5/1985 | Gentilman et al. | 501/98 |
| 4,686,070 A | | 8/1987 | Maguire et al. | 264/1.2 |
| 4,720,362 A | | 1/1988 | Gentilman et al. | 264/1.2 |
| 5,231,062 A | | 7/1993 | Mathers et al. | 501/96 |
| 5,668,440 A | * | 9/1997 | Inukai et al. | 313/635 |
| 5,861,714 A | * | 1/1999 | Wei et al. | 313/625 |
| 5,924,904 A | | 7/1999 | Fujii et al. | 445/58 |
| 6,020,685 A | * | 2/2000 | Wei et al. | 313/625 |
| 6,075,314 A | * | 6/2000 | Huettinger et al. | 313/332 |
| 7,247,591 B2 | * | 7/2007 | Wei | 313/636 |
| 2002/0032118 A1 | * | 3/2002 | Oshio | 313/491 |
| 2005/0258759 A1 | * | 11/2005 | Wei | 313/634 |
| 2006/0202627 A1 | * | 9/2006 | Dudik et al. | 313/634 |

FOREIGN PATENT DOCUMENTS

JP 9-92206 4/1997

OTHER PUBLICATIONS

P.A. Sienen, *High Intensity Discharge Lamps with Ceramic Envelopes*, Proceedings of the 7th International Symposium on the Science and Technology of Light Sources, The Illuminating Engineering Institute of Japan (Kyoto, Japan Aug. 27-31, 1995) 101-109.

V. Gauri et al., *The Rheology and Mechanical Properties of Ceramic Suspensions Near Critical Loadings*, Proceedings of the 9th International Symposium on the Science and Technology of Light Sources, Cornell University Press (Ithaca, NY Aug. 12-16, 2001) 385-386.

(Continued)

*Primary Examiner*—Peter Macchiarolo
(74) *Attorney, Agent, or Firm*—Robert F. Clark

(57) ABSTRACT

The present invention is a ceramic discharge vessel for use in high-intensity-discharge (HID) lamps. The discharge vessel has a ceramic body and at least one seal region comprised of an aluminum oxynitride material. The seal region further has a surface layer for contacting a frit material wherein the surface layer is less reactive than the aluminum oxynitride material with respect to the molten frit during sealing. Preferably, the surface layer has a lower nitrogen content than the aluminum oxynitride material. The less reactive surface acts to minimize the formation of bubbles in the sealing frit during the sealing operation.

11 Claims, 2 Drawing Sheets

OTHER PUBLICATIONS

T.M. Hartnett et al., *Optical and Mechanical Properties of Highly Transparent Spinel and Alon Domes*, SPIE vol. 505 Advances in Optical Materials (1984) 15-22.

S. Jüngst et al., *Improved Arc Tubes for Ceramic Metal Halide Lamps*, Proceedings of the 10th International Symposium on the Science and Technology of Light Sources, Insitute of Physics Publishing (Toulouse, France Jul. 18-22, 2004) 115-124.

H. Gorter et al., *Effects of Atmosphere on Sintering and Properties of Aluminum Oxynitride*, Ceramic Engineering and Science Proceedings, 24, 3 (2003) 433-439.

H. Willems et al., *Thermodynamics of Alon II: Phase Relations*, Journal of the European Ceramic Society 10 (1992) 339-346.

H. Willems et al., *Thermodynamics of Alon I: Stability at Lower Temperatures*, Journal of the European Ceramic Society 10 (1992) 327-337.

T.M. Hartnett et al., *Aluminum Oxynitride Spinel (ALON)—A New Optical and Multimode Window Material*, Ceramic Engineering and Science Proceedings, 3 (1983) 67-76.

J. McCauley et al., *Phase Relations and Reaction Sintering of Transparent Cubic Aluminum Oxynitride Spinel (ALON)*, Journal of the American Ceramic Society, vol. 62, No. 9-10, (1979) 476-479.

* cited by examiner

CERAMIC DISCHARGE VESSEL HAVING ALUMINUM OXYNITRIDE SEAL REGION

TECHNICAL FIELD

This invention is related to ceramic discharge vessels for high intensity discharge (HID) lamps at least partially constructed with an aluminum oxynitride ceramic. More particularly, this invention is related to sealing the aluminum oxynitride ceramic to a frit material.

BACKGROUND OF THE INVENTION

Ceramic metal halide lamps for general illumination utilize translucent polycrystalline alumina (PCA) discharge vessels. PCA is translucent, not transparent, due to birefringence of the hexagonal alumina grains. Because of the lack of transparency, a PCA discharge vessel is generally not suitable for focused-beam, short-arc lamps such as projection lamps and automotive headlights. For focused-beam lamps, a transparent ceramic like sapphire is required.

Aluminum oxynitride (AlON) is a transparent ceramic material with in-line transmittance values as high as that of sapphire. AlON has a cubic spinel structure and a composition that may be generally represented by the empirical formula $Al_{(64+x)/3}O_{32-x}N_x$ where $2.75 \leqq x \leqq 5$. The mechanical strength and thermal expansion of AlON are close to those of PCA, so that AlON should be able to survive the stresses in high-intensity discharge (HID) lamps. In fact, several sources have identified AlON as a material suitable for HID lamps, for example, Japanese Patent No. 09-92206 and U.S. Pat. Nos. 5,924,904 and 5,231,062.

SUMMARY OF THE INVENTION

There remain a number of technical difficulties which must be overcome for AlON to be considered as a reliable material for HID lamps. One in particular is the reaction of AlON with the glass/ceramic frit materials used to seal the discharge vessels. In a typical HID lamp, the function of the frit is to hermetically seal the ceramic body of the discharge vessel to the feedthrough portion of the electrode assembly. The reaction of the AlON with the frit results in the formation of gas bubbles in the frit that may degrade the quality and function of the hermetic seal, particularly when higher pressures are present in the discharge vessel. Thus, it would be an advantage to be able control or eliminate the formation of these bubbles.

It is an object of the invention to obviate the disadvantages of the prior art.

It is another object of the invention to control or eliminate the formation of bubbles in the frit seals of ceramic discharge vessels having aluminum oxynitride present in a seal region.

It is a further object of the invention to provide a method of treating a ceramic discharge vessel to yield a surface layer that is less reactive with a molten frit material.

In accordance with an aspect of the invention, there is provided a ceramic discharge vessel that comprises a ceramic body and at least one seal region comprised of an aluminum oxynitride material. The seal region has a surface layer for contacting a frit material, the surface layer being less reactive to the frit material during sealing than the aluminum oxynitride material.

In accordance with another aspect of the invention, there is provided a method of treating a ceramic discharge vessel. The method comprises providing a ceramic discharge vessel having a ceramic body and at least one seal region comprised of an aluminum oxynitride material, and heating at least the seal region in a reducing atmosphere to form a less reactive surface layer. Preferably, the seal region is heated in a $N_2$-8% $H_2$ atmosphere at about 1400° C. to about 1700° C. for about 1 to about 10 minutes.

In accordance with another aspect of the invention, an aluminum oxide layer is deposited on the seal region to form the less reactive surface layer.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

A preferred frit material for sealing ceramic discharge vessels is the $Dy_2O_3$—$Al_2O_3$—$SiO_2$ glass-ceramic system. This system is widely used by lighting manufacturers to seal PCA discharge vessels because of its halide resistance and favorable melting and thermal expansion characteristics. The $Dy_2O_3$—$Al_2O_3$—$SiO_2$ frit seal consists of DA ($3Dy_2O_3$-$5Al_2O_3$) and DS (Dy—Si—O) crystalline phases in a Dy—Al—Si—O glassy matrix. When sealed to PCA parts, some alumina from the PCA part is dissolved in the frit at the frit-PCA interface, but there are typically no bubbles in the frit seals of the PCA parts. As described previously, this is not the case when the same frit is used with aluminum oxynitride (AlON) parts.

Figure 4:
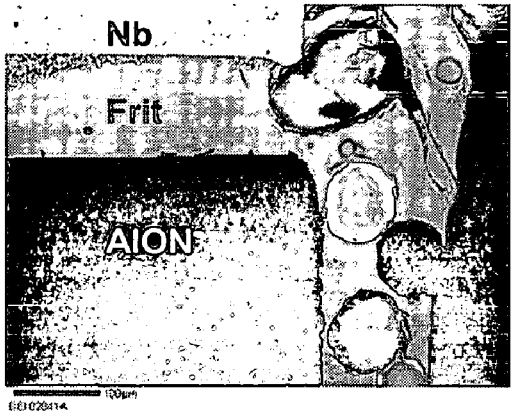
FIG. 4 is an SEM micrograph that shows the formation of bubbles in the frit region of an untreated aluminum oxynitride discharge vessel.

During the sealing operation, AlON in contact with the molten $Dy_2O_3$—$Al_2O_3$—$SiO_2$ frit reacts to become $Al_2O_3$ with some limited amount of nitrogen dissolved in the frit. Most of the nitrogen evolved from the reaction cannot be accommodated in the frit glass and escapes as gas bubbles in the frit melt. An example of the problem can be seen in FIG. 4 which is a photomicrograph of a cross section of a frit-sealed, as-sintered AlON capillary taken with a scanning electron microscope (SEM). The presence of large bubbles in the frit is clearly evident.

The reactions between the $Dy_2O_3$—$Al_2O_3$—$SiO_2$ frit and the aluminum oxynitride are believed to first involve the formation of a substoichiometric aluminum oxynitride, $Al_{23}O_{27}N_{5-x}$, as in Equation (1). As the nitrogen level in the Dy—Al—S—O glass reaches its solubility limit, more nitrogen gas is formed than can be dissolved in the molten frit.

$$Al_{23}O_{27}N_5+Dy—Al—Si—O \rightarrow Al_{23}O_{27}N_{5-x}+Dy—Al—Si—O_{1-y}—N_y+2(x-y)N_2+y/2O_2 \quad (1)$$

As the above reaction proceeds, the substoichiometric $Al_{23}O_{27}N_{5-x}$, eventually becomes $Al_2O_3$ plus AlN, as shown in Equation (2).

$$Al_{23}O_{27}N_{5-x} \rightarrow 9Al_2O_3 + 5AlN_{1-x/5} \quad (2)$$

In order to at least reduce the likelihood of the above reactions, the present invention involves forming a less reactive surface layer in at least the frit seal regions of the discharge vessel. In a preferred method, the AlON discharge vessel is heated in a reducing atmosphere to decompose the outer surface to form $Al_2O_3$ and AlN. The AlN may further react with a residual partial pressure of oxygen in the furnace to form $Al_2O_3$ and thereby reduce the amount of nitrogen in the surface layer. In the presence of molten frit, $Al_2O_3$ in the surface layer would tend to dissolve into the frit while any AlN that may still be present would not dissolve much at all. In addition, the presence of $Al_2O_3$ and AlN in the surface region would tend to shift the above reactions to the left, and thereby reduce the release of nitrogen gas. In an alternate method, the surface layer is comprised of an aluminum oxide layer that has been deposited at least on the seal region of the AlON discharge vessel. In this method, the aluminum oxide layer may be formed by any of several well-known techniques including reactive sputtering and chemical vapor deposition. Preferably, the aluminum oxide layer is 1 to 20 micrometers in thickness.

Figure 1:
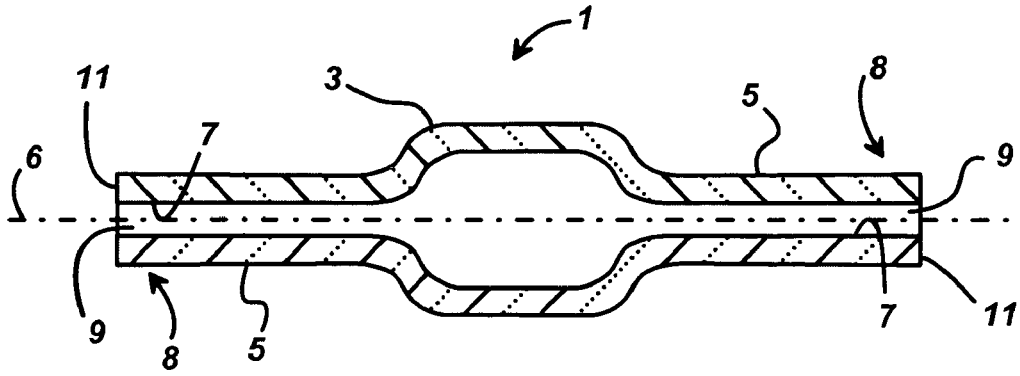
FIG. 1 is a cross-sectional illustration of a ceramic discharge vessel according to this invention.

Referring to FIG. 1, there is shown a cross-sectional illustration of a ceramic discharge vessel 1 for a metal halide lamp wherein the discharge vessel 1 has a ceramic body 3 comprised of an aluminum oxynitride material. The ceramic body 3 has opposed capillary tubes 5 extending outwardly from opposite sides along a central axis 6. The capillaries 5 have a central bore 9 for receiving an electrode assembly and a seal region 8 adjacent to the distal end 11 of the capillary 5. The seal region 8 has a surface layer 7 for contacting a frit material. The surface layer 7 is less reactive than the aluminum oxynitride material with respect to the molten frit during sealing. Preferably, the surface layer 7 has a lower nitrogen content than the bulk aluminum oxynitride material. The less reactive surface layer acts to minimize the formation of gas bubbles in the frit during sealing. Although it is preferred to have the entire discharge vessel made from aluminum oxynitride, it is not necessary for this invention. This invention also applies equally to ceramic discharge vessels that use other ceramic materials in conjunction with AlON, provided that AlON is used in the seal region. In the case where the whole discharge vessel is made from AlON, it is preferred to treat the entire discharge vessel including the seal region in order to reduce the number of processing steps. However, the treatment should not substantially adversely impact the transparency of the vessel. Otherwise, the treatment should be limited to the seal regions and other optically less important sections.

Figure 2:
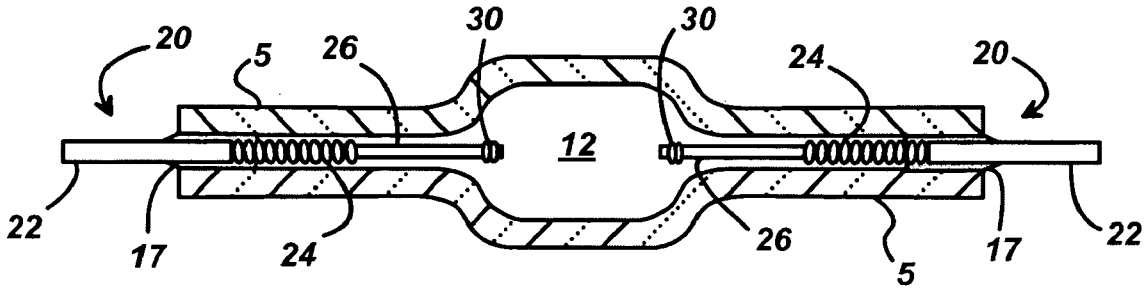
FIG. 2 is a cross-sectional illustration of the ceramic discharge vessel of FIG. 1 after the electrode assemblies have been sealed therein.

The ceramic discharge vessel of FIG. 1 is shown in FIG. 2 with the electrodes assemblies 20 sealed to capillaries 5. Discharge chamber 12 contains a metal halide fill material that may typically comprise mercury plus a mixture of metal halide salts, e.g., NaI, $CaI_2$, $DyI_3$, $HoI_3$, $TmI_3$, and TlI. The discharge chamber 12 will also contain a buffer gas, e.g., 30 to 300 torr Xe or Ar. Higher fill gas pressures may also be used, e.g., up to 30 bar Xe at 20° C. Such higher pressures are useful for lamps where instant starting is required, e.g., automotive lamps. The electrode assemblies in this embodiment are constructed of a niobium feedthrough 22, a tungsten electrode 26, and a molybdenum coil 24 that is wound around a molybdenum or Mo—$Al_2O_3$ cermet rod that is welded between the tungsten electrode 26 and niobium feedthrough 22. A tungsten coil 30 or other suitable means of forming a point of attachment for the arc may be affixed to the end of the tungsten electrode.

Figure 3:
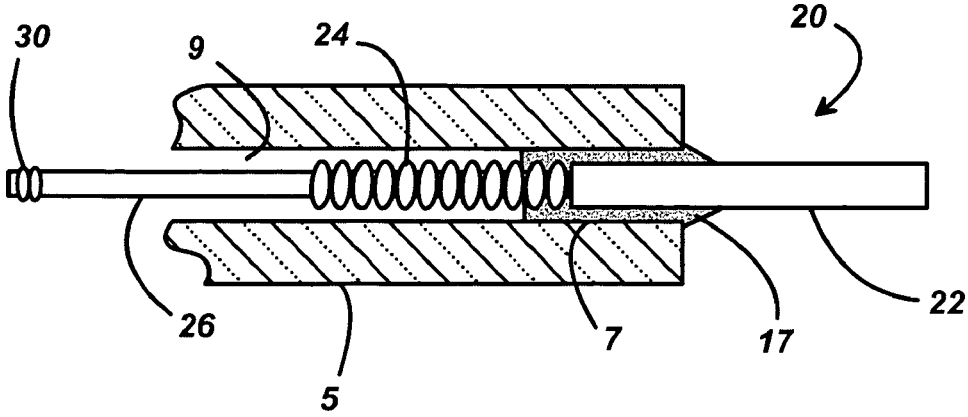
FIG. 3 is a magnified cut-away view of one of the frit seal regions of the discharge vessel shown in FIG. 2.

The frit material 17 creates a hermetic seal between the electrode assembly 20 and capillary 5. This is better seen in FIG. 3. The frit 17 in its molten state has flowed along the electrode assembly 20 to the molybdenum coil 24. Seal region 8 has been previously treated according to this invention to form the less reactive surface layer 7 to reduce reactions with the molten frit. Once solidified, the frit 17 forms a hermetic seal between the electrode assembly 20 and capillary 5. In metal halide lamps, it is usually desirable to minimize the penetration of the frit material into the capillary to prevent an adverse reaction with the corrosive metal halide fill.

The preferred frit material is a $Dy_2O_3$—$Al_2O_3$—$SiO_2$ frit having a composition of 67-68 wt. % $Dy_2O_3$, 11-16 wt. % $Al_2O_3$, and 22-13 wt. % $SiO_2$. Other oxide-based frits may also be used, e.g., $Dy_2O_3$—$Al_2O_3$—$SiO_2$—$La_2O_3$ and $Dy_2O_3$—$Al_2O_3$—$SiO_2$—$MoO_3$. Melting of the frit starts at about 1350° C. A typical frit sealing cycle involves: heating under vacuum to about 1000° C., holding at 1000° C. for a short time, filling with argon gas, fast heating to 1500-1650° C., holding at 1500-1650° C., and then fast cooling to solidify the frit. Crystallization upon cooling produces a complex mixture of several crystalline phases in a glassy matrix.

EXAMPLES

Figure 5:
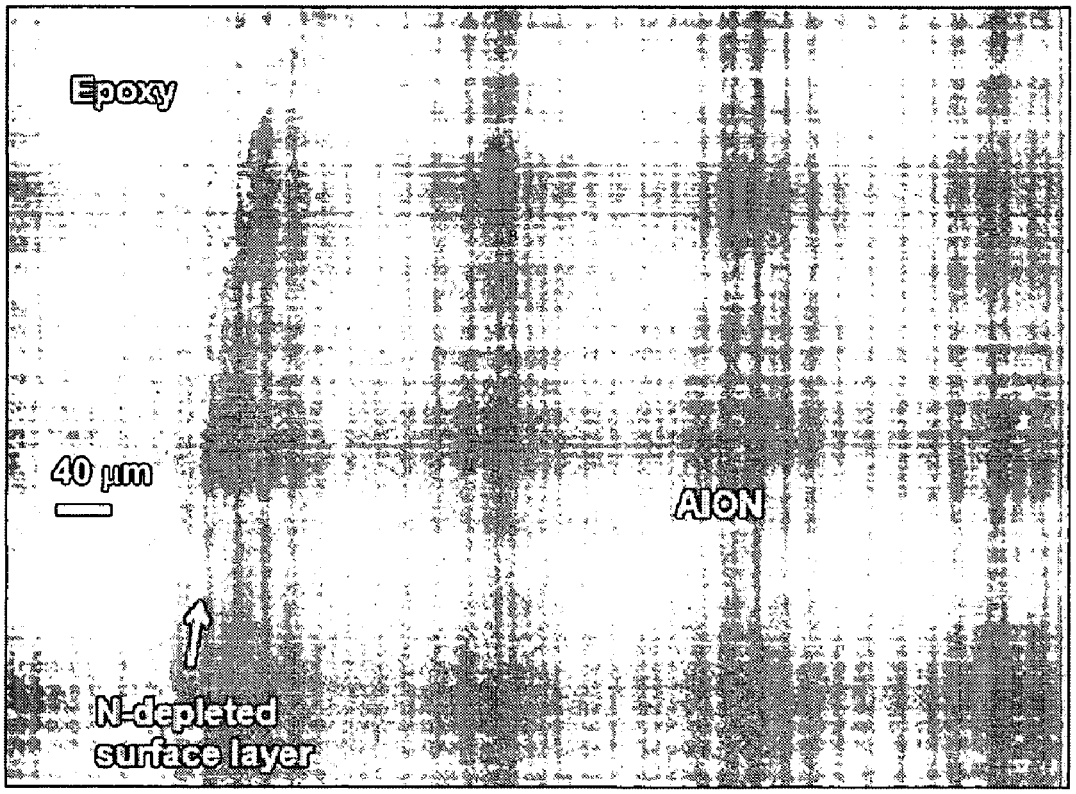
FIG. 5 is an optical photomicrograph of a cross section of a treated aluminum oxynitride capillary tube according to this invention.

An experiment was conducted to test the stability of AlON in a $N_2$-8% $H_2$ atmosphere at 1000° C. and 1200° C. for 100 hours. As-sintered AlON capillaries were used. The AlON parts remained clear and transparent after 100 hours at 1000° C. under $N_2$-8% $H_2$, but became translucent after 100 hours at 1200° C. under $N_2$-8% $H_2$. Polished sections indicated the formation of AlN and $Al_2O_3$ in the surface region of AlON treated under $N_2$-8% $H_2$ at 1200° C. for 100 h. This can be seen in FIG. 5 which is an optical photomicrograph of a cross section of the capillary. The surface layer appears as a slightly lighter band at the edge of the AlON capillary. Further investigation by energy-dispersive x-ray (EDX) analysis found that this surface layer had no detectable nitrogen present compared to the bulk AlON which is consistent with the decomposition of the AlON surface.

Limiting the AlON decomposition to a relatively thin surface layer is desirable so that the ALON parts are still translucent. Preferably the layer is from 1 to 20 micrometers thick. Other atmospheres such as air (AlON becomes $Al_2O_3$) could be used, but dry or wet hydrogen (AlON becomes AlN), or vacuum (AlON becomes sub-stoichiometric AlON), result in either more drastic or too little decomposition. More precise control is needed in order to limit the amount of decomposition. With a $N_2$-8% $H_2$ atmosphere, the decomposition is relatively easy to control so that it occurs only in the desired surface layer.

Another set of as-sintered AlON capillaries were treated in $N_2$-8% $H_2$ at 1650° C. for 1 minute and 10 minutes. The 1650° C. temperature was selected because it was a temperature that approximated normal $Dy_2O_3$—$Al_2O_3$—$SiO_2$ frit sealing conditions. The pretreated AlON capillaries along with controls (as-sintered AlON and PCA) were sealed under a variety of conditions with a $Dy_2O_3$—$Al_2O_3$—$SiO_2$ frit in a W-element, Mo-shield furnace under either vacuum or a static argon gas at various pressures (0.3 torr to 300 torr to 1 bar). A niobium wire was inserted into the end of the capillary and then a frit ring was placed over the protruding end of the wire and adjacent to the end of the capillary. The capillaries were sealed in a vertical orientation with frit ring placed on top. The pressure of argon gas during the frit sealing experiment was found to affect the decomposition of the frit itself. At high temperatures (1400-1600° C.) under vacuum, the frit itself would evaporate. A static pressure of argon gas was necessary to prevent premature vaporization of the frit.

The pretreatment to form the less reactive surface layer alters only the surface of the AlON, and does not significantly affect the translucency of the capillaries (which is required for observation of the frit flow during melting). The pretreated AlON capillaries clearly exhibited substantially fewer bubbles than the as-sintered AlON controls. This demonstrates that the pretreatment of the seal regions of aluminum oxynitride (AlON) discharge vessels will at least reduce the occurrence of bubbles in the frit during sealing.

While there has been shown and described what are at the present considered the preferred embodiments of the invention, it will be obvious to those skilled in the art that various changes and modifications may be made therein without departing from the scope of the invention as defined by the appended claims.

We claim:

1. A ceramic discharge vessel comprising: a ceramic body having at least one seal region, the seal region of the ceramic body being comprised of an aluminum oxynitride material and having a surface layer that has a lower nitrogen content than the aluminum oxynitride material, the surface layer being disposed in the seal region so that it contacts a frit material that forms a seal in the seal region and reduces a reaction between the frit material and the aluminum oxynitride material.

2. The ceramic discharge vessel of claim 1 wherein the whole ceramic body is comprised of an aluminum oxynitride material.

3. The ceramic discharge vessel of claim 1 wherein the ceramic body has two seal regions.

4. The ceramic discharge vessel of claim 1 wherein the ceramic body has at least one capillary tube extending outwardly from the ceramic body and the seal region is located in the capillary tube.

5. The ceramic discharge vessel of claim 1 wherein the surface layer is comprised of aluminum oxide.

6. The ceramic discharge vessel of claim 5 wherein the surface layer has a thickness of 1 to 20 micrometers.

7. A ceramic discharge vessel comprising: a ceramic body having at least one seal region, the ceramic body being comprised of an aluminum oxynitride material, the seal region of the ceramic body having a surface layer that has a lower nitrogen content than the aluminum oxynitride material, an electrode assembly passing through the seal region, and a frit material that seals the electrode assembly to the discharge vessel in the seal region, the surface layer being disposed in the seal region so that it contacts the frit material and reduces a reaction between the frit material and the aluminum oxynitride material.

8. The ceramic discharge vessel of claim 7 wherein the surface layer is comprised of aluminum oxide.

9. The ceramic discharge vessel of claim 7 wherein the surface layer has a thickness of 1 to 20 micrometers.

10. The ceramic discharge vessel of claim 1 wherein the frit material is comprised of $Dy_2O_3$, $Al_2\mathbf{0}_3$ and $SiO_2$.

11. The ceramic discharge vessel of claim 7 wherein the frit material is comprised of $Dy_2O_3$, $Al_2\mathbf{0}_3$ and $SiO_2$.

* * * * *